US005262792A

United States Patent [19]

Egashira

[11] Patent Number: 5,262,792

[45] Date of Patent: Nov. 16, 1993

[54] SHORTENED NON-GROUNDED TYPE ULTRASHORT-WAVE ANTENNA

[75] Inventor: Yoshimi Egashira, Kanagawa, Japan

[73] Assignee: Harada Kogyo Kabushiki Kaisha, Tokyo, Japan

[21] Appl. No.: 758,881

[22] Filed: Sep. 11, 1991

[51] Int. Cl.[5] ..... H01Q 1/24

[52] U.S. Cl. ..... 343/702; 343/749; 343/895

[58] Field of Search ..... 343/702, 715, 901, 895, 343/749, 856, 862, 906, 846

[56] References Cited

U.S. PATENT DOCUMENTS

| | | | |
|---|---|---|---|
| 4,739,516 | 4/1988 | Starkloff et al. | 343/745 |
| 4,760,401 | 7/1988 | Imazeki | 343/702 |
| 5,032,846 | 7/1991 | Chang | 343/715 |

*Primary Examiner*—Michael C. Wimer
*Assistant Examiner*—Tan Ho
*Attorney, Agent, or Firm*—Koda and Androlia

[57] ABSTRACT

A shortened non-grounded type ultrashort antenna including an antenna element, an electrostatic coupling element electrostatically coupled to the antenna element, a rectangular first metal member with one end thereof connected to the electrostatic coupling element and an other end thereof extending in a direction perpendicular to the axis of the antenna element, a second rectangular metal member provided underneath and in parallel and spaced apart from the first metal member and having one end thereof connected to the extending end of the first metal member and a feeder line connected to the first and second metal members.

2 Claims, 5 Drawing Sheets

SHORTENED NON-GROUNDED TYPE ULTRASHORT-WAVE ANTENNA

BACKGROUND OF THE INVENTION

1. Field of Industrial Utilization

The present invention relates to a shortened non-grounded type ultrashort-wave antenna that is used as a handy type wireless telephone antenna of, for instance, cellular telephone systems.

2. Prior Art

In handy type wireless telephones used in cellular telephone systems, there is an increasing demand for making them compact and light-weight. An improved performance, easy handling, etc. are also demanded along with a novel design.

In the handy type wireless telephone systems, it is necessary to use a non-grounded type antenna or an antenna similar to this type in order to maintain a constant performance level regardless of whether the telephone is in use or not. In addition, since the wireless telephone is an equipment for two-way communication, it is necessary that the antenna can receive all call signals from callers at any time.

In the handy type wireless telephones of earlier days, the antenna element sticks out of the telephone set to secure a minimum reception sensitivity at all times. However, in such a telephone system the antenna element, which has the same length as the height of the wireless telephone set, always sticks out. Such a projected antenna is, however, inconvenient when the telephone is not in use. In particular, it is extremely inconvenient when the telephone set is stored, transported, etc. For example, female users express dissatisfaction because they cannot put the wireless telephone set in their handbags due to the antenna element that is fixed projected. There are many other complaints.

In view of the above, it is desirable that a wireless telephone that has an antenna element which retracts inside the telephone set. The problems described above are indeed eliminated if an antenna is retractable. However, if the design change is only to make the antenna element retractable inside the wireless telephone set, there is naturally a severe drop in the gain, directionality and impedance of the antenna which are the three most important factors in the antenna function. As a result, call signals from callers cannot be received. In addition, since the antenna element must be extended when it is used and then retracted after the use, handling of the telephone set becomes more complicated. As a result, the "convenience" of the wireless telephone tends to be diminished.

Historically, the use of retractable antenna elements of the type described above has long been known. One well known antenna is an externally attached, shortened grounded type antenna having the length of $\lambda/4$. This antenna is obtained by shortening the overall length of the antenna element. The antenna requires no extension or retraction features and is mounted on a wireless telephone case; therefore, it has attracted a great deal of attention because it satisfies the demands described above. In other words, since there is no need to extend or retract the antenna element, handling of the antenna of is easy. In addition, since the length of the antenna element projecting from the case is extremely short, the antenna does not involve any inconvenience when the telephone is not in use, resulting in that the telephone set can fit into any handbag relatively easily.

Problems the Present Invention Attempts to Solve

However, even in the above-described conventional grounded type short antennas which are externally mounted on the telephone set, there are some drawbacks. More specifically, since the antenna is a grounded type, it is easily affected by the surrounding environment, and its reception sensitivity tends to fluctuate. Thus, the antenna is in fact not suitable for actual use. In addition, since the antenna element is dismountable, expensive coaxial connectors are necessary for the telephone set.

SUMMARY OF THE INVENTION

In view of the above fact, it is the object of the present invention to provide a shortened non-grounded type ultrashort-wave antenna in which an antenna element causes no inconvenience when the telephone is not in use. The antenna element of the present invention is in a fixed position regardless of whether the telephone is in use or not, thus making the telephone more convenient. In addition, the antenna element of the present invention retains antenna characteristics that provide a stable high sensitivity in a broad band compared to the sensitivity that is obtained by the conventional fixed antennas which are not a shortened type.

Means to Solve the Problems

The present invention utilizes the following means to achieve the object. In particular, the antenna of the present invention comprises:

1) an antenna element which is attached to an antenna mount section of a wireless telephone case and is shortened by spirally forming an inductive element so as to have an electrical length of less than $\lambda/2$, in which is the wavelength of the electromagnetic waves in the frequency band used;

an electrostatic coupling element provided in the antenna mount section and in close proximity to a coupling conductor of the antenna element so that the electrostatic coupling element is electrostatically coupled to the antenna element;

a rectangular first metal member having one end connected to the electrostatic coupling element and the other end extended in a direction parallel to the axis of the antenna element, a second metal member which has an electrical length of $\lambda/4$ and is installed parallel underneath the first metal member with a predetermined gap in between, one end of the second metal member being connected to the first metal member, and a feeder line connected to a point which is near another point where the second metal member and the first metal member are connected;

so that the electrostatic capacitance between the first and second metal members and the inductance of the first metal member are set so that parallel resonance is obtained with respect to the frequency band used.

2) In addition, the following means is further employed. In particular, the electrostatic capacitance in an electrostatic coupling section, that is made up by the coupling conductor of the antenna element and the electrostatic coupling element, and the residual inductance of the antenna element, are set so that a constant-K band-pass filter is formed with respect to the frequency band used.

Effect of the Invention

As a result of the above-described means, the present invention retains the following effects:

1) When the antenna is attached to the telephone set, the electrostatic capacitance between the first and second metal members and the inductance of the first metal member resonate in parallel with respect to the frequency band used. As a result, the antenna element can have a high impedance, thus realizing a non-grounded type antenna. Furthermore, since one end of the feeder line is connected in the vicinity of the connection point between the first and second metal members, impedance matching between the antenna element and the feeder line is obtained by merely setting the connection point at a desired position. Moreover, since the second metal member having approximately λ/4 electrical length of the frequency band used is employed as a ground wire, the base portion, which is a coupling conductor, of the antenna does not require a large installation space.

2) A serial-resonance-section, which is made up of the electrostatic capacitance in the electrostatic coupling section and the residual inductance of the antenna element which is an inductive element with an electrical length of less than λ/2, and a parallel resonance-section, which is formed between the first and second metal members, form a constant-K band-pass filter with respect to the frequency band used. Accordingly, it is possible to increase the usable frequency band, and even though a shortened antenna element is used, the sensitivity is the same as that obtained by a non-shortened antenna element.

3) Since the antenna element is connected to the feeder line with an electrostatic coupling section in between, the antenna can be in a conductive state in terms of high-frequency but in an insulated (non-contact) state in terms of direct current. Accordingly, the antenna element can be attached to the , antenna mount section of the casing of the wireless telephone set by a simple screwing means. In other words, there is absolutely no need to use an expensive coaxial connector, etc. which is required in the conventional devices to mount the antenna element. Furthermore, since the coupling resulted from C of the constant-K band-pass filter formed by LC has a broad characteristic, there is no loss of antenna characteristics even if the antenna is installed by the user. Accordingly, the antenna element is replaced easily.

BRIEF DESCRIPTION OF THE DRAWINGS

FIG. 1(*b*) is a perspective view which shows the outside appearance of the antenna.

DESCRIPTION OF THE PREFERRED EMBODIMENT

Figure 1A:
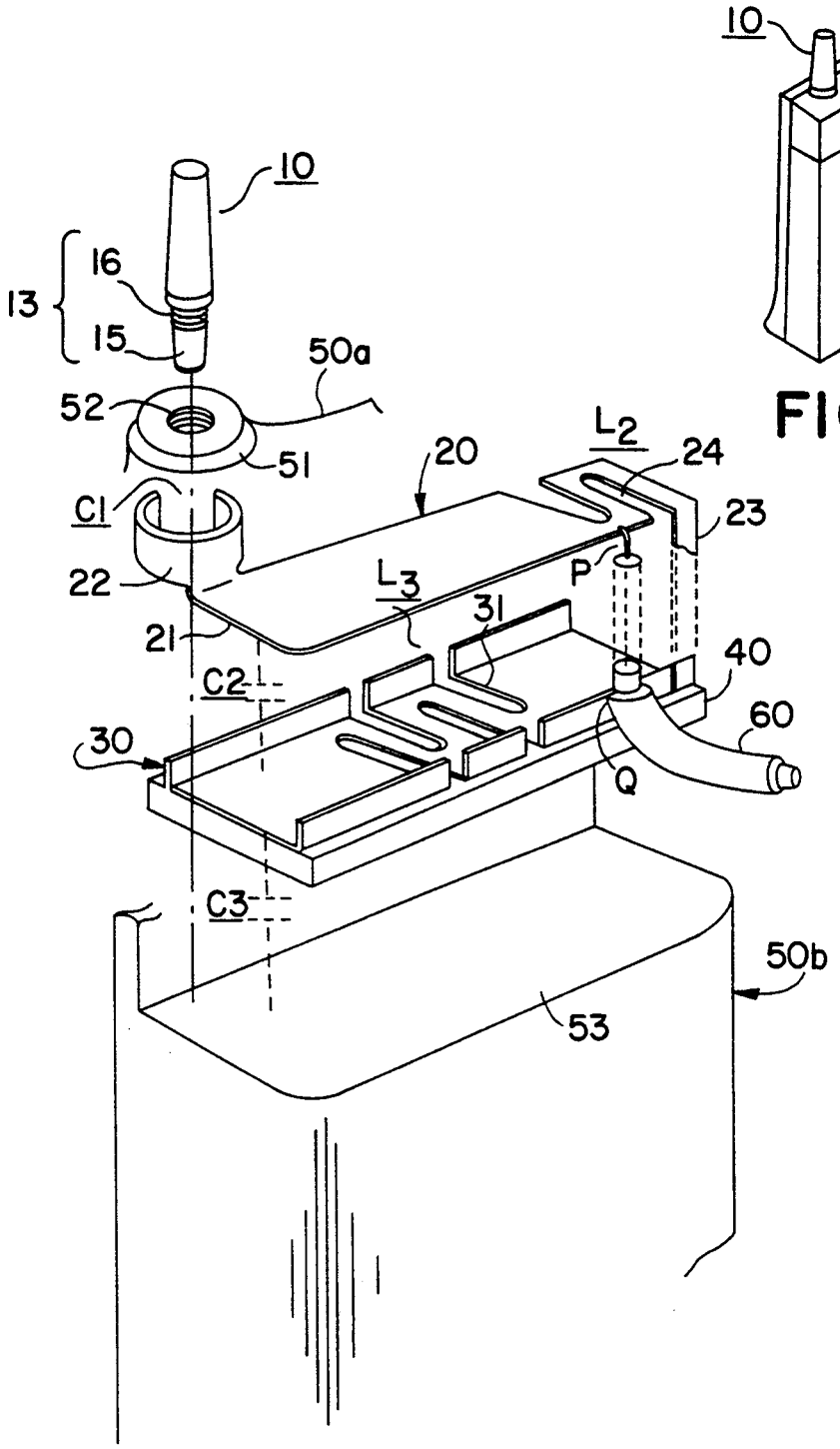
FIG. 1(*a*) is an exploded perspective view showing the primary section of the shortened non-grounded type ultrashort-wave antenna according to one embodiment of the present invention.
Figure 1B:
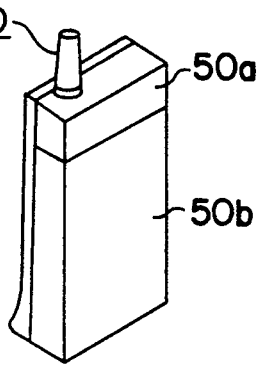
Figure 2:
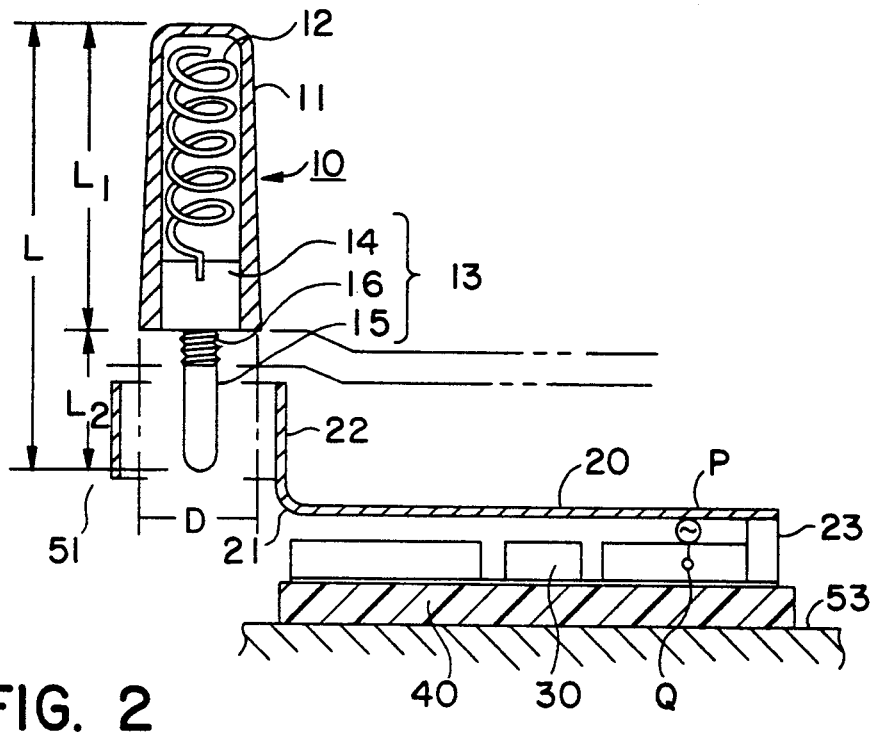
FIG. 2 is a cross sectional view of the essential section of the antenna mounted on the antenna mount section in the embodiment.

In FIGS. 1(*a*) and 1(*b*) and FIG. 2, reference numeral 10 is a shortened antenna element. The antenna element 10 is made of an inductive element having an electrical length of less than λ/2 in which λ is the wavelength of the electromagnetic waves in the used frequency band and is shortened by forming it in a helical shape. The antenna element 10 is detachably mounted on upper casing 50*a* via a screw 16 of the antenna element 10 connected to a threaded portion 52 of the antenna mount section 51 which is in the upper casing of the wireless telephone set. Reference numeral 50*b* is the lower casing of the wireless telephone set.

The upper casing 50*a* includes an antenna matching section and inner part of the antenna. Since the electromagnetic waves must be radiated out of the casing, the upper casing is made of plastic. The lower casing 50*b*, on the other hand, contains electrical circuitries, etc., and in order to avoid electromagnetic radiation from entering into the lower casing through the antenna element, it is made of metal and in a completely shielded structure.

The antenna element 10 consists of a cylindrical case 11 with a closed upper end, a helical coil conductor 12 provided inside the cylindrical case 11, and a coupling conductor 13. A head 14 of the coupling conductor 13 is installed inside the opening of the case 11 and connected to one end of the helical coil conductor 12. The coupling conductor 13 consists of the head 14, a cylindrical portion 15 which downwardly extends from the head 14, and a screw portion 16 which is at the base of the cylindrical portion 15. The screw portion 16 is for connecting the antenna element 10 to a threaded-portion of the antenna mount section 51.

The antenna element 10 is a non-grounded type antenna with an electrical length of, for example, 3λ/8. The overall length L of the antenna element 10 is 37 mm (with 25 mm for the length L1 of the case and 12 mm for the projecting length L2 of the coupling conductor), and the external diameter D of the antenna element is 10.2 mm. Thus, the space occupied by the antenna element 10 is extremely small.

Reference numeral 20 in the Figures is a rectangular first metal member. A ring-shaped (or flat-form, etc.) electrostatic coupling element 22 is formed near one end 21 of the first metal member 20 as an integral part thereof. The electrostatic coupling element 22 is mounted with and coupled to the antenna mount section 51 so that it coaxially surrounds the coupling conductor 13 of the antenna element 10 is electrostatically coupled to the coupling conductor 13.

Figure 3:
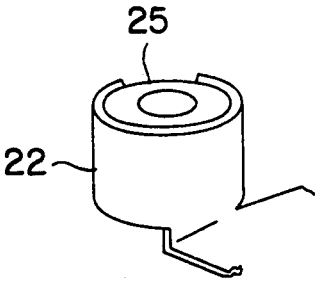
FIG. 3 is a perspective view of a modification of the electrostatic coupling element.
Figure 4:
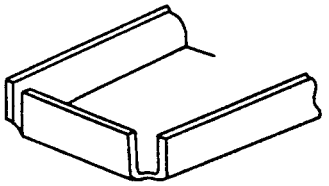
FIG. 4 is a partial perspective view of modification of the second metal member.

The electrostatic coupling element 22 may contain an insulation ring 25 therein as shown in FIG. 3.

The other end 23 of the first metal member 20 is extended in a direction parallel to the axis of the antenna element 10 and connected to one end of a second metal member 30 which will be described later. Near the end 23 of the first metal member 20, a zigzag-shaped cutout 24, which provides the second metal member 30 with a prescribed inductance L2, is formed.

The second metal member 30, that has an electrical length of λ/4, corresponds to the ground wire of a Brown antenna. The second metal member 30 is installed parallel to the first metal member 20 with a predetermined gap (several mm) in between. The second metal member 30 is connected, at its one end, to the end 23 of the first metal member 20 and is grounded via the outer conductor, etc. of the feeder line 60 as will be described below. A zigzag-shaped cutout 31 is formed substantially at the center of the second metal member 30. The cutout 31 is similar to that formed in the first metal member 20 and is used to improve the radiation efficiency. Each cutout portion of the zigzag cutout 31 is oriented so as to be perpendicular to the length-wise direction of the second metal member 30. By this zigzag cutout 31, a "loading coil" with an inductance L3 is obtained in the second metal member 30. In addition, both side edges of the second metal member 30 are bent into an L shape. The purpose of this bending is to lower the Q factor by broadening the width of the second metal member 30, thus contributing to the broadening of the frequency band used. Of course, this structure can help increase the mechanical strength of the second metal member 30. A similar construction may also be taken in the first metal member 20. Furthermore, it is also possible to form the bent portions at both ends or one end of the second metal member 30. Thus, it is possible to not only broaden the frequency band but also shorten the antenna, maintaining an improved antenna efficiency.

Reference numeral 60 is a feeder line, which is a coaxial cable. One end of the feeder line 60 is connected to a point which is in the vicinity of the connection point between the second metal member 30 and the first metal member 20. More specifically, the core of the feeder line 60 is connected to a tap position P of the first metal member 20, and the outer conductor of the feeder line 60 is connected to a point Q on the second metal member 30.

The tap position P can be shifted to another location on the first metal member 20 so that the impedance Z0, when looked at the signal source side from the antenna side, can match the antenna input impedance with is 50 ohms. In other words, as described above, by positioning the tap position P, where the core of the feeder line 60 is connected to the first metal member 20, at a desired location, the impedance matching between the antenna element and the feeder line can be accomplished relatively easily.

The undersurface of the second metal member 30 is attached to the top surface of the lower casing **50*b* with a dielectric 40, which has a predetermined thickness, in between. In this case, an electrostatic capacitance C2 is created between the first metal member 20 and the second metal member 30; accordingly, in view of the above-described structure, a stray capacitance C3 is created between the undersurface of the second metal member 30 and the top surface of the lower casing 50*b*. A stray capacitance, meanwhile, generally lowers the parallel resonance frequency of a ground wire. Accordingly, the electrical length of the second metal member 30** can be shortened because the resonance is accomplished in the frequency band used. More specifically, if $\sqrt{LC}$ is constant in the formula:

$$f_r = 1/2\pi\sqrt{LC}$$

then, L decreases as C increases. Accordingly, the length of the second metal member 30, which works as a ground wire, can be short.

With the structure described above, when the antenna element 10 is mounted, the electrostatic capacitance C2 between the first metal member 20 and the second metal member 30 and the inductance L2 of the first metal member 20 are set such that they resonate in parallel with respect to the frequency band used. A non-grounded type antenna is thus obtained.

Meanwhile, a serial-resonance-section that consists of the electrostatic capacitance Cl at the electrostatic coupling section (which consists of the coupling conductor 13 of the antenna element 10 and the electrostatic coupling element 22 and the residual inductance La of the antenna element (which has an electrical length slightly shorter than λ/2) and a parallel-resonance-section (which is between the first and second metal members) are designed such that a constant-K band-pass filter is formed with respect to the frequency band used. Accordingly, broad-band characteristics are obtained, and a sensitivity, (or a gain) which is 0±1 dBd and about the same as that obtained by a non-shortened antenna, can be obtained even though the helical shortened antenna element is used in the present invention. Incidentally, the maximum gain that can be obtained by a conventional grounded type external short antenna is only about −3 dBd.

Furthermore, the antenna element 10 is connected to the feeder side (or feeder line 60) with the electrostatic coupling section in between. Accordingly, the antenna is in a conductive state in terms of high-frequency but in an insulated (or non-contact) state in terms of direct current. As a result, the mounting of the antenna element 10 to the antenna mount section 51 of the upper casing **50*a*** of the wireless telephone set can be accomplished merely by means of screwing. In other words, when the antenna element is mounted, there is absolutely no need to use a coaxial connector, etc., which is usually expensive, as is required in the conventional devices. In addition, the coupling based on the C of the constant-K band-pass filter, that is formed by the LC, has a broad characteristic; accordingly, no antenna characteristic loss occurs even when the users mount the antenna of the present invention, thus ensuring an easy antenna replacement.

Figure 5:
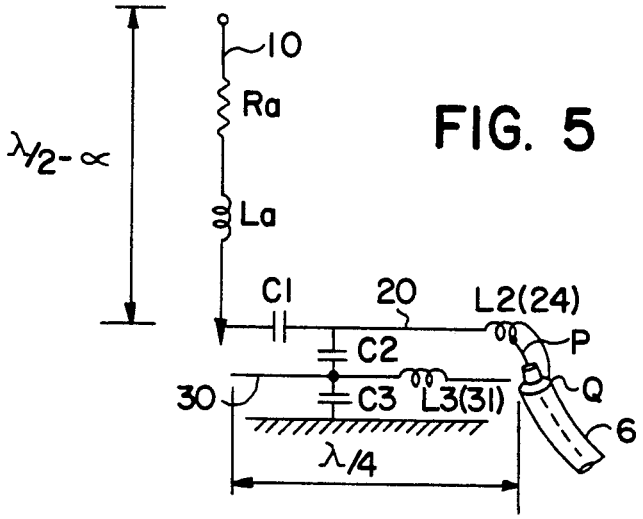
FIG. 5 is a diagram which shows the electrical structure of the antenna of the present invention.
Figure 6:
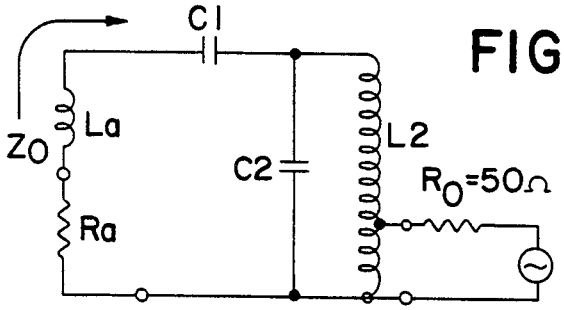
FIG. 6 shows an equivalent circuit used in the structure of FIG. 5.
Figure 7:
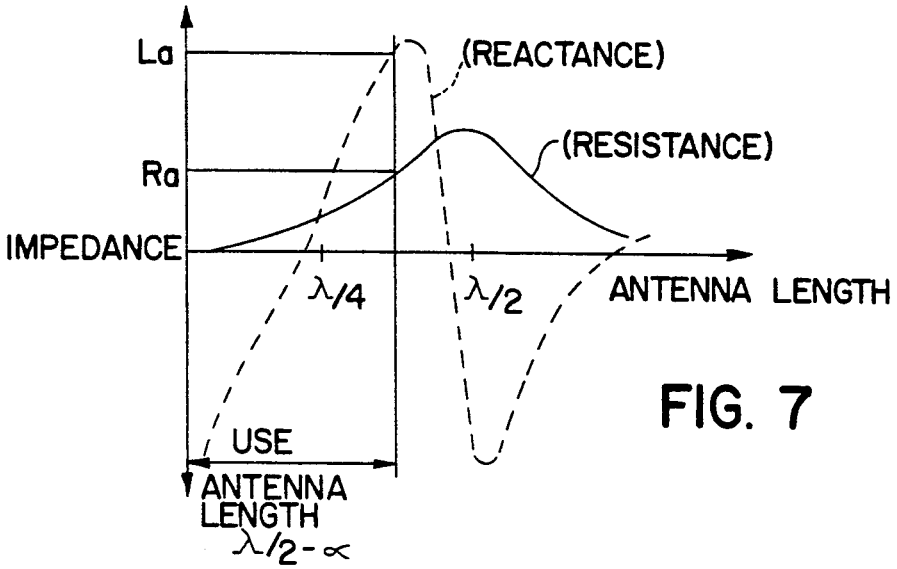
FIG. 7 is a graph showing the characteristics of the antenna of the present invention.

FIGS. 5 through 7 illustrate the electrical relationships in the antenna described above. FIG. 5 illustrates the electrical structure of the antenna of the present invention. FIG. 6 shows an equivalent circuit used therein. FIG. 7 shows the antenna characteristics of the present invention.

As shown in FIG. 7, the electrical length of the antenna element is in the middle of λ/4 and λ/2; in other words, the electrical length is λ/2−α (alpha). Thus, the antenna element 10 is slightly shorter than the parallel tuning point so that it has broad-band and high performance characteristics.

Figure 8A:
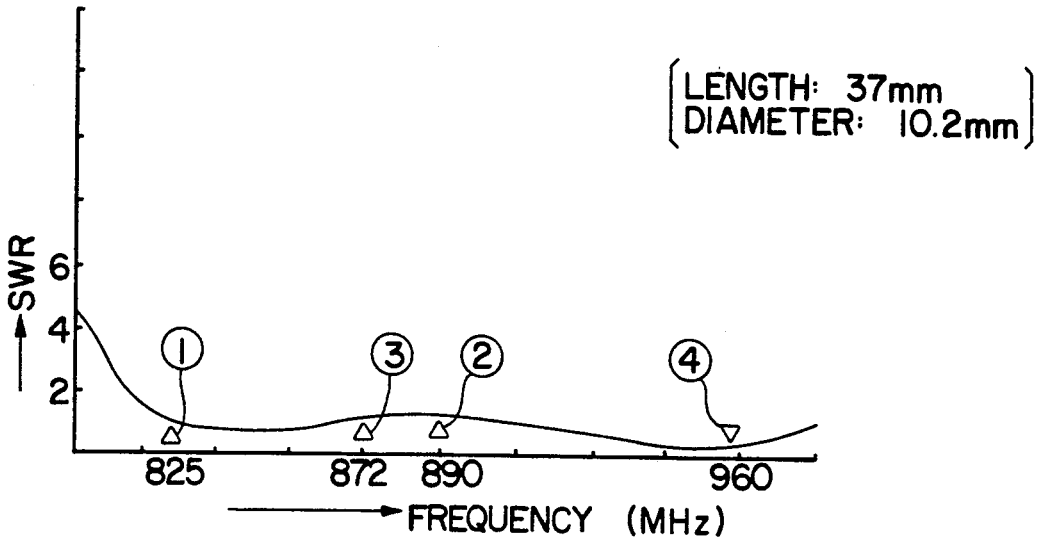
FIG. 8(*a*), 8(*b*), 9(*a*), and 9(*b*) show the test data of the antenna characteristics according to the present invention.
Figure 8B:
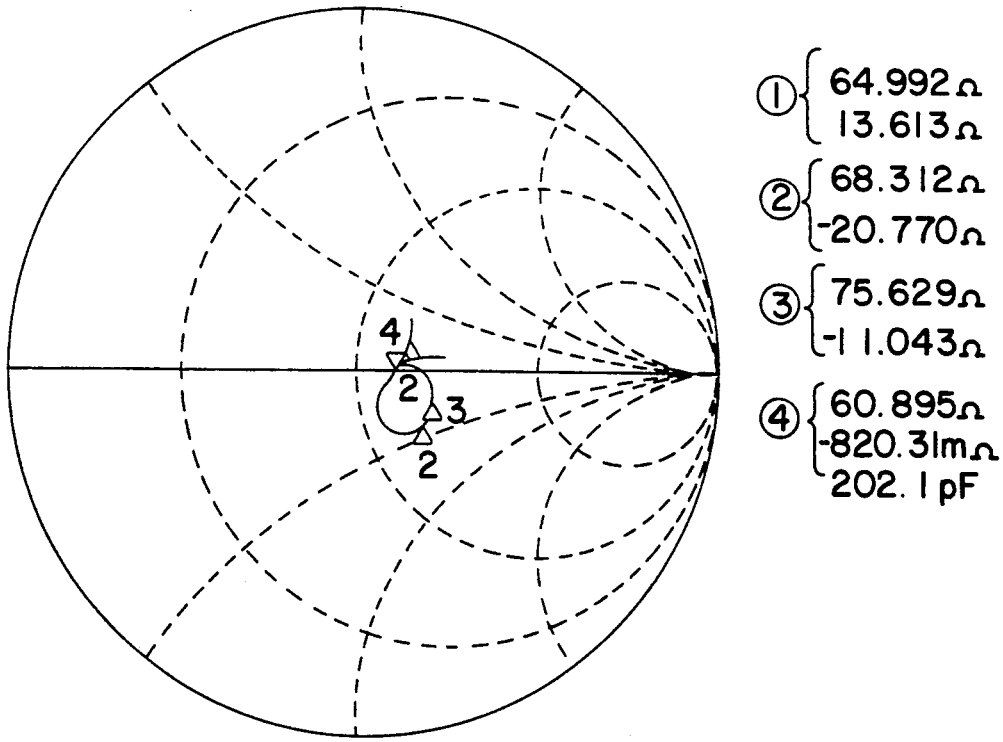

FIGS. 8(*a*) and 8(*b*) show the test data of the SWR characteristics and the impedance characteristics of the antenna of the above-described embodiment. The SWR value is less than 1.5 throughout the entire frequency range, thus showing broad-band characteristics. The frequency band used in the embodiment is 825 to 960 MHz.

Figure 9A:
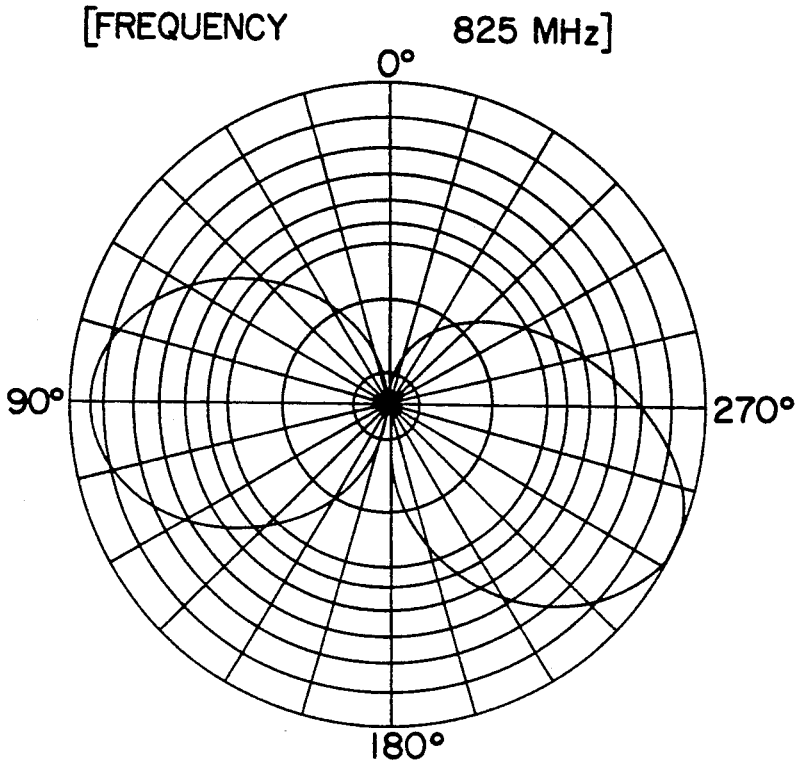
Figure 9B:
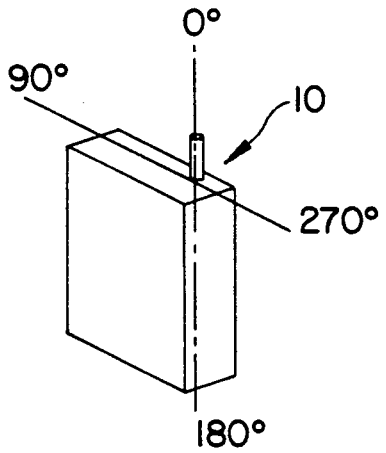

FIGS. 9(*a*) and 9(*b*) show the electromagnetic-wave vertical-plane pattern of the antenna of the embodiment. The gain is in the range of $0 \pm 1.0$ dBd in a standard dipole antenna ratio in the frequency band used. As seen from these FIG. s, the direction of the maximum radiation is more or less horizontal relative to all directions.

It was, accordingly, confirmed by the test that the antenna of the present invention is adequate for practical use in terms of both impedance characteristics and gain.

The approximate sizes of the first metal member 20, the second metal member 30 and the dielectric 40 of the antenna used in the test were all 45 mm long, 14 mm wide, and 7 mm high.

The present invention is not limited to the embodiment described above. In other words, any means of shortening the antenna element other than forming the antenna element in a helical shape can be utilized. Many other modifications can be taken within the limits not departing from the spirit of the present invention.

As seen from the above, according to the present invention, the antenna element causes no inconvenience when the telephone is not in use and can remain in a fixed projected state regardless of use or non-use of the telephone. Accordingly, the antenna makes it easy to use the wireless telephone. In addition, the present invention provides a shortened non-grounded type ultrashort-wave antenna which has a stable antenna characteristics and high sensitivity throughout the entire broad band which is the same as that obtained by the conventional non-shortened fixed antennas.

I claim:

1. A shortened non-grounded type ultrashort-wave antenna characterized in that said antenna comprises:

an antenna element attached to an antenna mount section of a case of a wireless telephone set and formed by shortening an inductive element lengthwise so as to have an electrical length of less than $\lambda/2$ where $\lambda$ is a wavelength of an electromagnetic wave in a frequency band used;

an electrostatic coupling element is mounted with and coupled to said antenna mount section in close proximity to a coupling conductor which is at a base of said antenna element and electrostatically coupled to said antenna element;

a rectangular first metal member with one end thereof connected to said electrostatic coupling element and the other end extended in a direction parallel to an axis of said antenna element;

a rectangular second metal member provided underneath and in parallel to said first metal member with a space inbetween, said second metal member having electrical length of $\lambda/4$ and having one end thereof connected to said other end of said first metal member; and a feeder line with one end thereof connected to points on said first and second metal members which are in the vicinity of a point where said second metal member is connected to said first metal member;

wherein an electrostatic capacitance between said first and second metal members and an inductance of said first metal member are set so as to resonate in parallel with respect to said frequency band used.

2. A shortened non-grounded type ultrashort-wave antenna according to claim 1, wherein a series-resonance-section and a parallel-resonance-section are formed so that a constant-K band-pass filter is created with respect to said frequency band used, said parallel-resonance-section being formed between said first and second metal members, and said series-resonance-section being formed with an electrostatic capacitance at an electrostatic coupling section which comprises said coupling conductor of said antenna element and said electrostatic coupling element, and a residual inductance of said antenna element.

* * * * *